United States Patent [19]

Adams et al.

[11] Patent Number: 4,574,189

[45] Date of Patent: Mar. 4, 1986

[54] TAXIMETER ASSEMBLY

[75] Inventors: Jürgen Adams; Hans-Peter Scholl, both of Villingen-Schwenningen, Fed. Rep. of Germany

[73] Assignee: Kienzle Apparate GmbH, Villingen-Schwenningen, Fed. Rep. of Germany

[21] Appl. No.: 737,343

[22] Filed: May 23, 1985

[30] Foreign Application Priority Data

May 26, 1984 [DE] Fed. Rep. of Germany ..... 3419773

[51] Int. Cl.[4] ..... G07B 13/00

[52] U.S. Cl. ..... 235/30 R; 235/29 A; 235/45

[58] Field of Search ..... 235/29 A, 30 R, 30 A, 235/33, 45

[56] References Cited

U.S. PATENT DOCUMENTS

| | | | |
|---|---|---|---|
| 2,650,757 | 9/1953 | Weisinger | 235/30 R |
| 3,809,312 | 5/1974 | Warrick et al. | 235/30 R |
| 4,039,780 | 8/1977 | Kelch et al. | 235/30 R |
| 4,095,737 | 6/1978 | Schuh et al. | 235/30 R |
| 4,209,688 | 6/1980 | Kelch | 235/30 R |

*Primary Examiner*—Benjamin R. Fuller

*Attorney, Agent, or Firm*—Toren, McGeady, Stanger, Goldberg & Kiel

[57] ABSTRACT

A taximeter assembly including an electronic calculating module with data memory, an operating keyboard, as well as a data indicating device, consists of two flat housing panels which are joined by detent devices and which are secured together by a lead-sealable screw connection. An electronic taximeter circuit wired on a single printed circuit board is installed between the housing panels and feed-in of all electrical transmitter lines and supply lines is effected, as desired, from the rear or from below, wherein the latter are guided directly to connectors on the printed circuit board. The rear wall of the rear housing panel is constructed, at the same time, as a mounting plate for installation in a vehicle. A compact, extremely flat taximeter device having its circuitry in a single printed circuit board system enables arrangement of the device in an optimal installation position within or on the outside of the dashboard of a vehicle.

11 Claims, 2 Drawing Figures

TAXIMETER ASSEMBLY

The present invention is directed to a taximeter assembly of the type including electronic calculating means comprising data memory or storage means, an operating keyboard, as well as a data indicating device for displaying the actual operating data and the stored data on demand.

As is known, a taximeter is used for calculation of taxi fares and, in this capacity, it is always installed in a taxi or similar vehicle. The fare calculation is effected on the basis of an evaluation of two parameters consisting of travel distance and time. Based upon a preset mathematical interrelationship, fare amounts are calculated by means of multiplication as well as preset factors and these fare amounts are indicated in an indicating device. The device requires testing and approval by a Bureau of Standards (Office of Weights and Measures) for price calculation in a vehicle used on a rental basis, after which the device is lead-sealed in the installation position so that the operator of the vehicle cannot influence the functioning of the device by means of illegal tampering.

Thus, in previously known devices, it has been necessary to provide complicated housing superstructures which are mounted on base plates fixedly installed in the vehicle and all housing parts are secured by applying a plurality of lead seals in order to protect all the lines or conduits, such as lines for distance data transmitters which transmit a number of revolutions determined by the distance covered, current supply lines, roof signal control lines, etc.

Moreover, it is required in the installation of a taximeter that the indicator data can be viewed as easily as possible by the driver and passengers. Also, accommodation of the taximeter should not have a disadvantageous effect on the space requirement of the passenger and the driver. In order to meet these demands, in commonly known installations, the taximeter has been arranged between the driver and the front seat passenger, beneath the dashboard. As a rule, special retaining plates are required for this purpose, and the indicator panel cannot be viewed by a passenger at the rear of the vehicle.

Furthermore, such an arrangement impedes maintenance, service and, in most cases, the device must be completely disassembled, requiring a complete resecuring by the Bureau of Standards after reinstallation. This expense is also necessary, for example, when a simple change of rate adjustment is to be made in the taximeter device.

Finally, it is the case in all vehicle types that, because of the number of vehicles utilized for taxi operation, there are no special provisions in the area of the dashboard permitting an optimal installation of a taximeter device.

In order to avoid the necessity of going through the entire procedure of installation and disassembly, the removal of the connections and the renewal of all the lead seals by an examiner of the Bureau of Standards with the expenditure of time connected therewith, at least when adjusting for a rate change, a support apparatus is known from DE 25 30 390 which provides a simplified, lead-sealable fastening of a taximeter in a vehicle. Firstly, this apparatus requires a support plate mounted in the vehicle. A base plate with a rear wall is provided as part of the taximeter housing which can be slipped onto this support plate and which is constructed as a frame and secures the installation position after lead-sealing it. In order to accommodate and secure the lines, a special cover plate is required which is connected with the rear wall via plug connections and is secured in the installation position by means of substantially right-angled, upwardly bent projections at the support plate.

Finally, in order to cover a plurality of printed circuit boards mounted on the base plate, an expensive upper housing part is required which consists of the cover wall, two lateral walls and a front side for receiving the front viewing plate. The large quantity of housing parts, including the fastening means, which are very expensive in terms of construction and cost, creates, in itself, a considerable disadvantage and also causes considerable difficulty with respect to assembly and maintenance. Because of the single installation arrangement of the taximeter device on the support plate fastened horizontally in the vehicle, which arrangement results necessarily because of the construction of the support plate and base plate and can only be carried out in the area of a center bracket or support, limitations on the supply of space and hindrances in the actuation of the device and reading of data must be taken into account.

SUMMARY OF THE INVENTION

It is the object of the invention to enable realization of an electronic taximeter with an extremely flat construction capable of simple installation, depending on the vehicle construction or on its dashboard, respectively, in any installation position desired by the driver or the passenger.

The basic concept of the invention is embodied in a device which consists of two flat housing panels which can be connected together by means of interlocking detent means and which are secured by means of a lead-sealable screw connection, with an electronic taximeter circuit wired in a single printed circuit board system being installed between the panels, wherein the front housing panel, which is the housing part facing the operator's side, contains the actuating elements, as well as an exchangeable indicia face plate, the rear housing shell serves as a carrier element for receiving the electronic circuit and is equipped with means for feeding the cable connections from the rear or from below, as desired, and the rear wall is constructed, at the same time, as a mounting plate for fastening the device in the vehicle.

By means of the solution according to the characteristic features indicated, an electronic taximeter, which is particularly suitable for arranging the device in the vehicle in front of, or on the dashboard or the center bracket, is constructed with an extremely flat configuration. In order to achieve this, the housing is constructed from two flat housing panels which can be assembled without additional means.

The rear housing panel is used for receiving fastening of the entire electronic circuit arranged on a single printed circuit board and the simplest measures are provided which allow all cable connections to be guided into the taximeter device from the rear or from below, as desired. This signifies an optimization of the conditions for installing the taximeter in any position preferred for the driver and passenger. Since the rear wall of the rear housing panel, in addition to being provided with means for receiving and fastening the single printed circuit board, is also provided at the same time with means for mounting the device in the vehicle, the taximeter, as an installed device, can also be screwed on, e.g., at any free surface of the dashboard body, in an entirely novel manner without neglecting the safety measures for protecting against external manipulation. In the rear wall, small protuberances with formed blind end bores are provided through which the device can be screwed, e.g., from the inside, on a suitable surface at the dashboard. Accordingly, in a closed and lead-sealed device, the installation connection with the vehicle, the connections from outside at the circuit and, also, the circuit itself, can be secured from the outside against any attempt at tampering.

This securing is also ensured in that the lateral walls of the two housing shells meeting one another on the front side are alternatley rabbeted outwardly and inwardly so that when the housing shells are joined together, a rabbet joint forming an overlapping housing connection results. Nondestructive penetration into the housing interior and manipulation of the circuit and its connections are accordingly prevented and can only be carried out through a clearly recognizable destruction of the housing parts.

Finally, the compact manner of construction with the aim of optimizing independent installation is achieved in that the entire electronic circuit means is arranged on a single printed circuit board which is equipped on both sides and is constructed, at the same time, as a carrier plate for the data indicator apparatus. Moreover, all connections for the transmitter and supply lines are directly connectable with plug-type connectors on the printed circuit board so that, in addition to an inexpensive approach to the development of a single board system, a considerable reduction in sources of error and expenditure on testing means can be achieved. Also, a multiple-pole or multiple contact diode socket or jack is provided on the single printed circuit board, which is accessible from the outside through the front housing shell and functions as the connection of a programming and diagnostic connector. Since rate programming of the taximeter is reserved only for authorized persons, this function must also be protected by lead sealing. For this purpose, an opening secured by means of a cover plate is provided in the area of the lead-sealable screw in the front housing shell, through which opening access can be provided for actuating a programming release and test switch on the printed circuit board after removing the lead seal and the screw. Accordingly, a single safety lead seal simultaneously secures the test switch, the two-part housing, the connections of the lines in the device and installation of the device in the vehicle.

The various features of novelty which characterize the invention are pointed out with particularity in the claims annexed to and forming a part of this disclosure. For a better understanding of the invention, its operating advantages and specific objects attained by its use, reference should be had to the drawings and descriptive matter wherein there is illustrated and described a preferred embodiment of the invention.

BRIEF DESCRIPTION OF THE PREFERRED EMBODIMENTS

Figure 1:
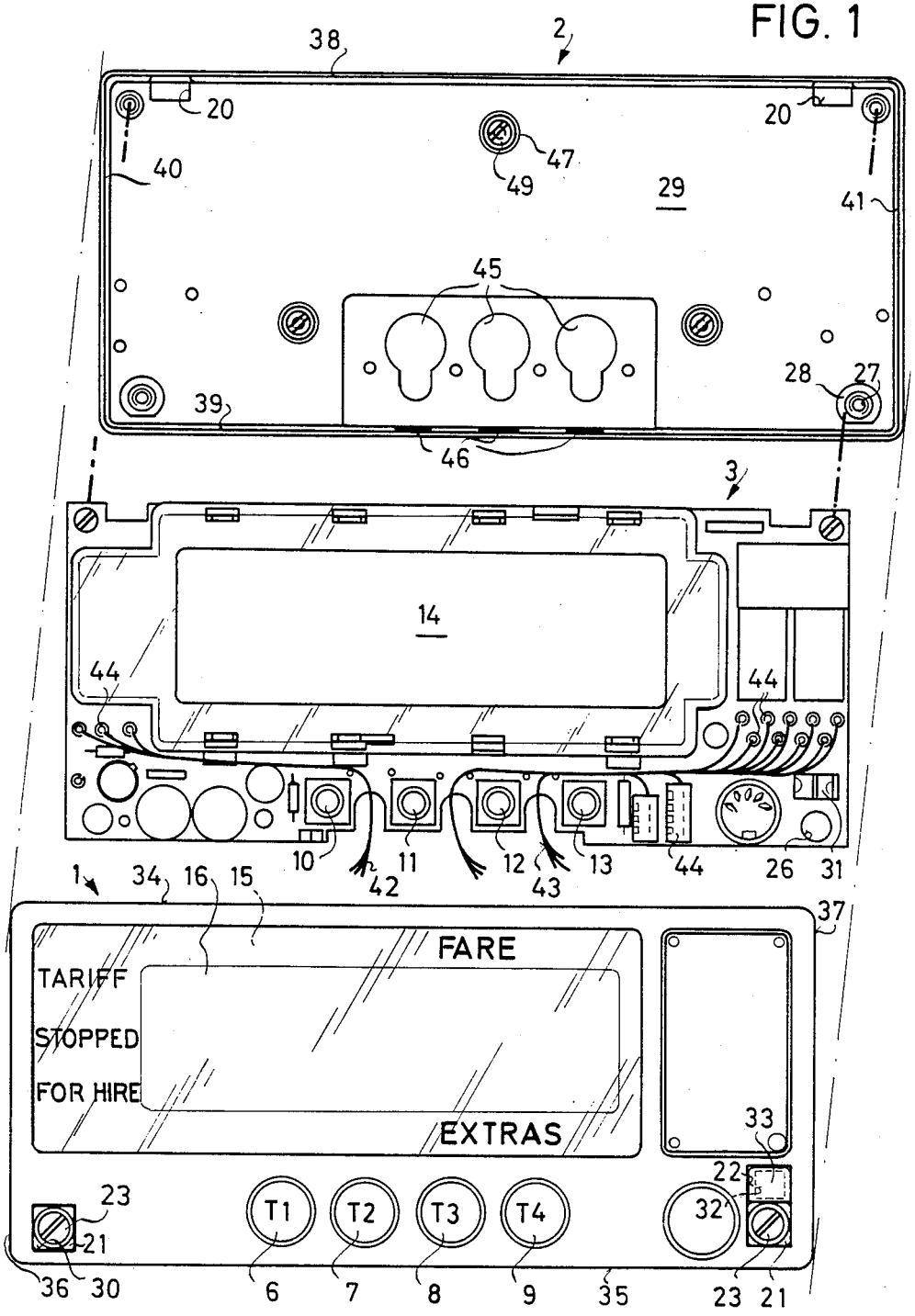
FIG. 1 is an exploded front view of the taximeter assembly of the invention consisting of a front housing panel, printed circuit board and rear housing panel.
Figure 2:
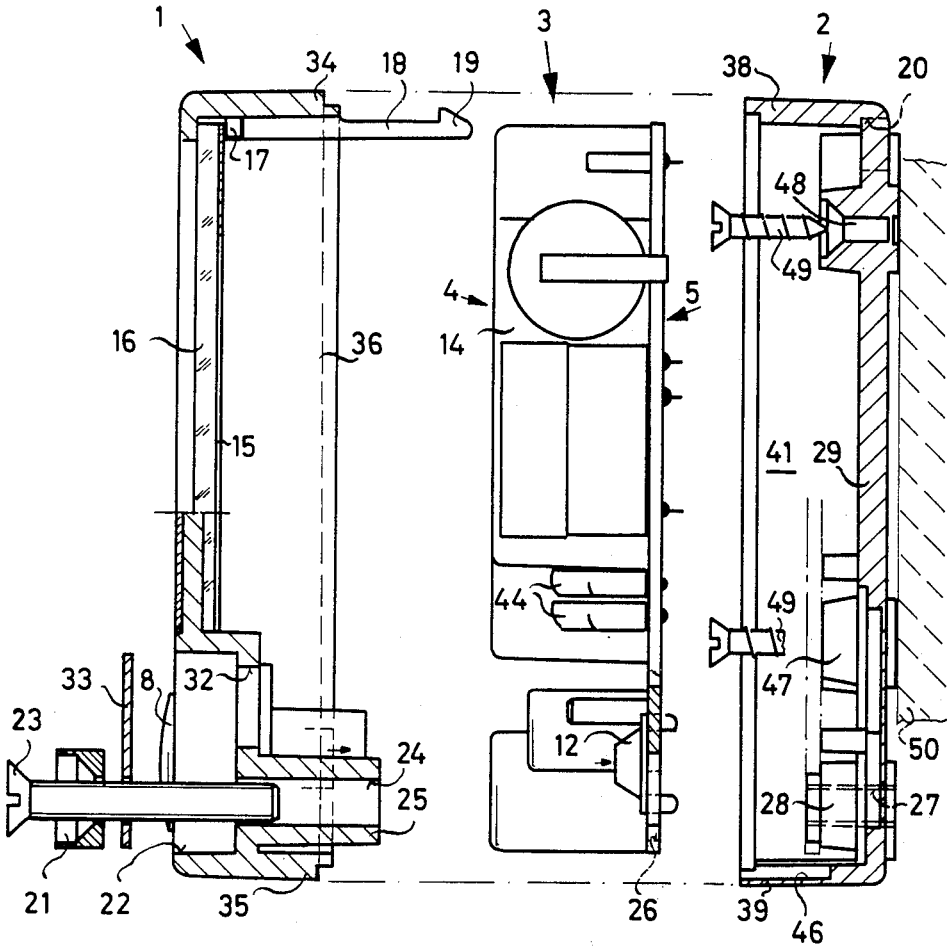
FIG. 2 is a side view of the parts, according to FIG. 1, shown partly in section.

Referring now to the drawings, FIGS. 1 and 2 show an embodiment of the invention which comprises a taximeter assembly consisting essentially of only two flat housing panels 1 and 2 in which an electronic taximeter circuit 4 and 5 wired on a single printed circuit board 3 is installed in a single board system. The housing panel 1 is the housing part facing the operator's side and accordingly contains actuating elements 6, 7, 8, 9 which are constructed as pushbuttons T1, T2, T3, T4. The actuating elements 6, 7, 8, 9 are inserted in the front housing shell 1 and, when the housing is closed, they act on switches 10, 11, 12, 13 securely arranged in corresponding positions on the inserted printed circuit board.

In terms of function, a multiple use is assigned to each individual key T1 to T4 and to each individual switch 10 to 13, respectively, which multiple use is stored in a memory on the basis of a programmable functioning assignment. Substantially, by actuating the key T1 or the switch 10, the rate selection is switched on, and by repeated actuation, it can be switched in the sequence charge stage I to charge stage IV, and, after that, further to the states "charge and "free". In addition, a plurality of special functions stored in the program memory are also possible.

The actuation of the press switch 11 is used, according to the standard program, for reverse switching within the selected charge stages, for example, from charge stage IV to charge stage III to I, as desired.

Moreover, special functions, such as, e.g., recalling the control sum readings stored in the electronic memories and displaying the same, according to the sequence, in a data indicating device 14, which simultaneously serves as a fare indicating device, are enabled by actuation of switch 11. Summation of fare amounts and extra amounts, such as additional charges, as well as an indicator check or control which can be initiated manually as a special function, are effected by actuating the press switch 12.

Finally, when actuating the switch 13, keying of an extra amount can be performed and, when the process is repeated, summation thereof and indication of the total extra amount can be carried out.

In order to distinguish the data appearing in the data indicating device 14, an exchangeable character face plate 15 is provided which is insertable in the front housing panel 1 and which is inserted together with a front plate 16 into the housing panel 1 from the rear and is held by means of formed-on fitting strips 17.

The two housing panels 1 and 2 are connectable by means of detent means 18, 19, 20 and are secured by means of lead-sealable screw connections 23. The detent means 18, 19, 20 consist of resilient locking arms 18 with locking projections 19 formed on at the front housing panel in one piece which is produced from elastomer plastic material. The locking arms 18 and locking projections or catches 19 engage into cutout portions 20 provided at the rear housing panel 2 in the connected position of the two housing panels 1, 2. The lead-sealable screw connection consists only of a lead seal shell 21 inserted in a cutout portion 22 at the front of the housing panel 1 and of a fastening screw 23, which can be screwed in through the lead seal shell 21, a throughput borehole 24 in a supporting member 25 at the housing panel 1, through a bearing borehole 26 into the printed circuit board 3 and, finally, into a threaded borehole 27 in a supporting member 28 on a rear wall 29 of the housing panel 2.

A similar screw connection is provided on the left side, as seen in FIG. 1, which is constructed for receiving another lead seal shell 21 on the basis of a similar arrangement and construction of a cutout portion 30 in the housing panel 1. A second lead seal is of use in case access is to be obtained to a programming release and test switch 31 on the printed circuit board 3 by means of breaking the first lead seal. All remaining safety measures, such as closure, sealing or locking of the housing, securing the internal line connections and the measures for mounting the taximeter in the vehicle, must be maintained.

The cutout portion 22 in the housing wall has in the upper half an opening 32 extending therethrough, wherein the opening 32 is secured by means of a cover plate 33 by means of the lead-sealable fastening screw 23. Access for actuating the programming release and test switch 31 can be provided, as already explained, via the opening 32 after breaking the lead seal.

In order to secure the electronic circuit, conceived in accordance with the single printed circuit board system, on the printed circuit board 3, wherein all electronic components are placed on the printed circuit board 3, the housing panels 1 and 2 have rabbets in the area of the lateral walls 34, 35, 36, 37 of the housing panel 1, which lateral walls 34, 35, 36, 37 meet on the front side, and the laterals walls 38, 39, 40, 41 of the housing panel 2 have rabbets in such a way that an overlapping rabbet joint housing connection results when the housing panels 1 and 2 are joined together.

In order to meet the demand for receiving all electronic components in a single printed circuit board 3, the latter is constructed simultaneously as a carrier plate for a compact data indicating device 14. All transmitter lines 43 and all supply lines 42 are guided in the interior of the device directly to connectors 44 securely arranged on the printed circuit board 3, whereby connection errors are considerably reduced. For this purpose, rearwardly and downwardly directed predetermined breakout zones 45, 46, respectively, are provided in the rear wall 29 and the housing wall 39 of the housing panel 2, which predetermined breakout zones 45, 46 can be broken out in dependence upon the selected installation position and correspond to the requirements of the cable feed. Accordingly, rearward or downward guidance of the transmitter lines 43 and supply lines 42 is made possible. By means of directly guiding the protected transmitter lines 43 and supply lines 42 into the interior of the taximeter device to the connection points on the printed circuit board 3, all error sources are prevented by means of a plurality of connection bridges and, on the other hand, the securing of all connections of the lines is ensured by means of the lead-sealable fastening screw 23 when the housing is closed.

The mounting of the device in a vehicle requires practically no extra expenditure in that the rear wall 29 of the housing panel 2 is constructed at the same time as a mounting plate for fastening the taximeter. For this purpose, a plurality of small protuberances 47 are provided which reinforce the rear wall 29 and which have formed therein blind end bores 48, by means of which, the device can be fastened on the inside or on the outside on an installation surface 50 by means of self-threading screws 49. A screw connection of the housing panel 2 with the installation surface 50 in which the screws 49 are tightened from the interior of the housing through the blind end bores 48 into the installation surface offers the advantage that the installation position of the taximeter is absolutely secured after closing the device by means of the lead-sealed fastening screw 23. But the lead-sealed taximeter device cannot be disassembled when fastened from the outside with the self-tapping screws 49 since, for this purpose, a severing of all transmitter lines 43 and supply lines 42, which are securely connected with the printed circuit board outside the device, could not be circumvented. Also, if there is no installation surface for direct mounting of the taximeter, fastening of the taximeter device by means of the simplest installation holder can be used in the form of an angular sheet metal gusset, since the rear wall 29 which is constructed as a mounting plate also provides all the requirements for variable accommodation by means of different fastening means.

While a specific embodiment of the invention has been shown and described in detail to illustrate the application of the inventive principles, it will be understood that the invention may be embodied otherwise without departing from such principles.

What is claimed is:

1. In a taximeter assembly including electronic calculating means having data storage capacity, an operating keyboard and data indicating means for displaying actual operating data and stored data upon request, the improvement comprising:

housing means consisting essentially of a front and a rear flat housing panel;

detent means interlocking said front and rear panels together;

lead-sealed screw connection means securing said front and rear panels together;

electronic taximeter circuit means mounted on a single printed circuit board installed between said front and rear housing panels;

actuating elements and an exchangeable face plate having operating indicia thereon mounted on said front housing panel;

said rear housing panel being arranged to serve as a carrier element receiving said electronic taximeter circuit means and being equipped with means for feeding cable connections therethrough, said rear housing panel simultaneously operating as the mounting plate for said assembly for fastening said assembly in a vehicle.

2. An assembly according to claim 1, wherein said means for feeding cable connections through said rear housing panel are arranged to feed said cable connections from the rear thereof.

3. An assembly according to claim 1, wherein said means for feeding cable connections through said rear housing panel are arranged to feed said cable connections from below thereof.

4. An assembly according to claim 1, wherein said detent means consist of resilient locking arms which are formed as a unitary piece with said front housing panel from elastomer plastic material, said arms having locking projections which engage in cutout portions provided in said rear housing panel when said front and rear housing panels are connected together.

5. An assembly according to claim 1, further comprising screw fastening means for securing said front and rear housing panels together, said screw fastening means comprising at least one fastening screw which is insertable from the front of said assembly for connecting said front housing panel with said rear panel, said fastening screw being adapted to be sealed with lead.

6. An assembly according to claim 3, wherein said front and rear housing panels are formed with rabbets to form therebetween a rabbeted joint structured so that an overlapping connection results between said housing panels when said panels are joined together.

7. An assembly according to claim 1, wherein said single printed circuit board having said electronic taximeter circuit means mounted thereon is constructed to serve simultaneously as a carrier plate for said data indicating means.

8. An assembly according to claim 1, further comprising transmitter lines and supply lines guided into the interior of said assembly directly to connectors on said printed circuit board.

9. An assembly according to claim 1, further comprising downward and rearward predetermined breakout zones provided in one of said housing panels, said predetermined breakout zones being adapted to be broken away to enable a downward and rearward guidance of electrical transmitter lines and supply lines for said assembly.

10. An assembly according to claim 1, wherein said rear housing panel is formed with a rear wall constructed as a mounting plate for enabling fastening of said assembly in a vehicle, said rear wall having small protuberances which reinforce said rear wall and which comprise formed blind end bores through which the assembly may be fastened from the inside thereof onto an installation surface by self-tapping screws.

11. An assembly according to claim 1, further comprising a programming release and test switch on said printed circuit board, an opening defined in said front housing panel through which access may be provided for actuating said programming release and test switch, a lead-sealable fastening screw and a cover plate for securing said front panel, said front and rear housing panels being connected and secured together by means including connections of all internal electrical supply lines and transmitter lines as well as fastening means for mounting said assembly on a vehicle, said lead-sealable fastening screw operating to secure said assembly against external tampering.

* * * * *